United States Patent [19]

Olson

[11] 3,953,944

[45] May 4, 1976

[54] TOOL HOLDER CONSTRUCTION

[76] Inventor: Edwin R. Olson, 425 Bluebonnet Lane, Hoffman Estates, Ill. 60172

[22] Filed: Aug. 12, 1974

[21] Appl. No.: 496,543

[52] U.S. Cl. ..... 51/170 TL; 51/62; 51/205 R

[51] Int. Cl.[2] ..... B24B 23/04

[58] Field of Search ..... 51/170 R, 170 TL, 204, 51/205 R, 62

[56] References Cited

UNITED STATES PATENTS

| | | | |
|---|---|---|---|
| 639,701 | 12/1899 | Basener | 51/205 R X |
| 1,005,637 | 10/1911 | Friebertshauser | 51/205 R |
| 2,332,613 | 10/1943 | Swank | 51/170 TL |
| 3,763,531 | 10/1973 | Dancsik | 51/170 TL X |

*Primary Examiner*—Harold D. Whitehead
*Attorney, Agent, or Firm*—Neuman, Williams, Anderson & Olson

[57] ABSTRACT

A tool holder for use with a die profiler assembly utilizing a power device imparting reciprocating motion to the holer is provided. The holder employs a flexible wand attached at one end to the power device; an apertured tool-holder blade is secured to the opposite end of the wand for engaging a finishing tool such as an abrasive stone mounted at a desired angle to the wand axis. A retaining clip assists in maintaining the stone in assembled relation with the wand and blade. In a modified holder construction, superimposed, longitudinally adjustable, apertured wands may be employed to hold the stone at a desired angular disposition without the need for a retaining clip.

12 Claims, 6 Drawing Figures

20
18
22
29
28
26
14
27
24
23
12
T
155°
16
16A
15
16B
10
13
30

TOOL HOLDER CONSTRUCTION

BACKGROUND OF THE INVENTION

This invention relates to a novel tool holder for use with a die profile assembly or the like which may be employed in removing minute surface portions in the course of die and mold finishing operations. Dies and molds utilized in casting or plastic molding are generally made by cutting and grinding away the material of a mold block to define a cavity. Thereafter the cavity has relatively rough surface portions which must be removed prior to use so that a desired "finish" may be imparted to the cavity. The die or mold finish is then imparted to the metal or plastic parts which are subsequently formed in the cavity. In the finishing operation the surface portions are removed by a cutting or abrasive tool in an operation which may be in the nature of a lapping operation.

The prior art has employed power devices for purposes of reciprocating cutting tools such as chisels and lapping stones over mold and die surfaces to be finished. The power devices of the prior art die profilers may reciprocate the cutting or finishing tools actuated thereby through a predetermined variable stroke as in Riedl U.S. Pat. No. 3,007,230 granted on Nov. 7, 1961 which discloses an electrically energized finishing tool. Reciprocatory motion may also be imparted to a finishing abrasive as by means of an air-powered device such as is disclosed in Von Scheven U.S. Pat. No. 2,197,626. The use of power driven profiling devices is known in the art as evidenced by the disclosures of the foregoing patents. However the ability of the surface of a finishing tool such as an abrasive stone to be adjusted to yieldably and more efficiently finish the surface being processed has been very limited.

SUMMARY OF THE INVENTION

It is an object of this invention therefore to provide a novel tool holder construction for use with a die profiler assembly which provides yieldable support for the finishing tool to permit quick and expedient adjustment of the approach angle to the surface being finished and tool pressure. Such ability to change and adapt insures the most efficient and expeditious performance of the finishing process on flat surfaces as well as surfaces having significant variances in surface contour.

It is another object of this invention to provide a novel tool holder which enables an operator to adjust the angular approach of the finishing tool to the work surface in an exceedingly simple manner thereby facilitating an efficient surface finishing operation in complete safety.

It is a further object of this invention to provide a versatile tool holder which enables the tools held thereby to reach all mold surfaces including deep slot surfaces, curved surfaces, side walls and surfaces of molds which are continuously varying in nature and include points of inflection.

It is another object of this invention to provide a tool holder in which new cutting edges of abrasive stone tools held thereby may be presented to the surface being worked by mere manipulation of the profiler. Such versatility insures maximum use from the stones employed while minimizing breakage of the stones held by such tool holder.

DESCRIPTION OF THE FIGURES

The above and other objects of this invention will become more apparent from the following description when read in the light of the appended claims and accompanying drawings in which:

DESCRIPTION OF THE INVENTION

Figures 1, 2:
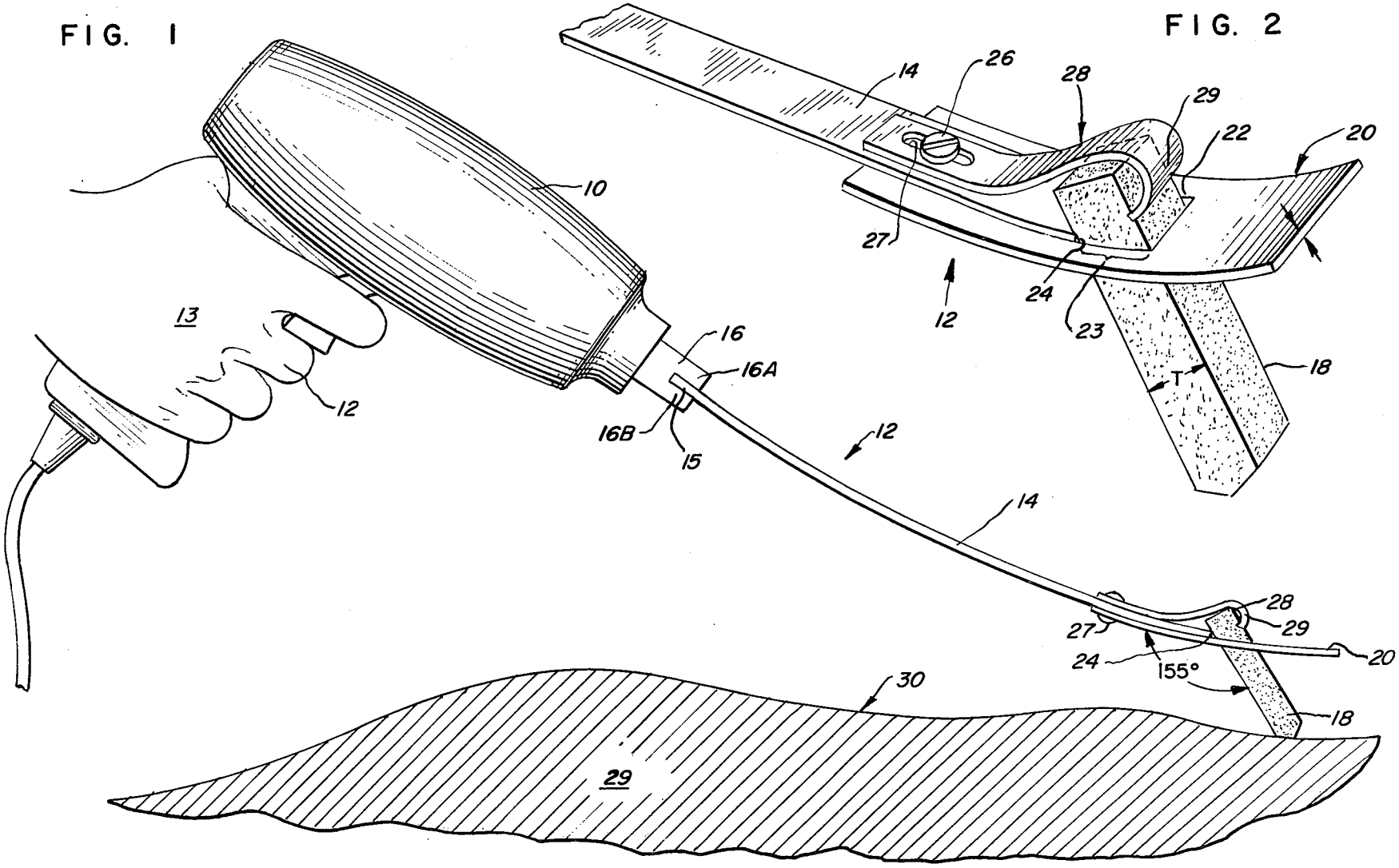
FIG. 1 is a side elevational view of a die profiler in a normal position of use in which a finishing stone is supported in a tool holder made in accordance with this invention and applied to a mold surface.
FIG. 2 is an enlarged fragmentary perspective view of the tool holder and stone assembly of FIG. 1.
Figure 3:
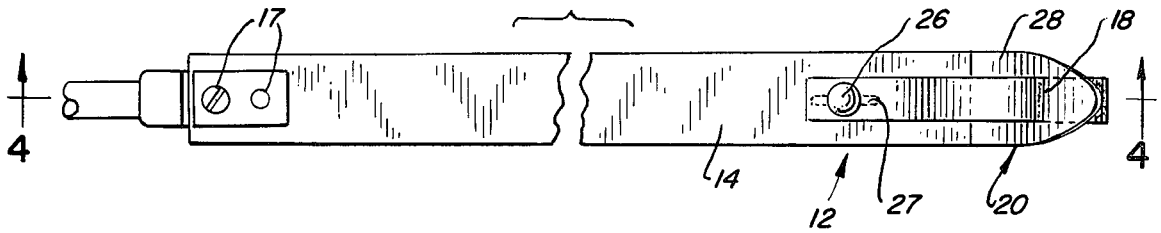
FIG. 3 is a fragmentary top plan view of one embodiment of the tool holder of the invention illustrating its attachment to a power device for reciprocation.
Figure 4:
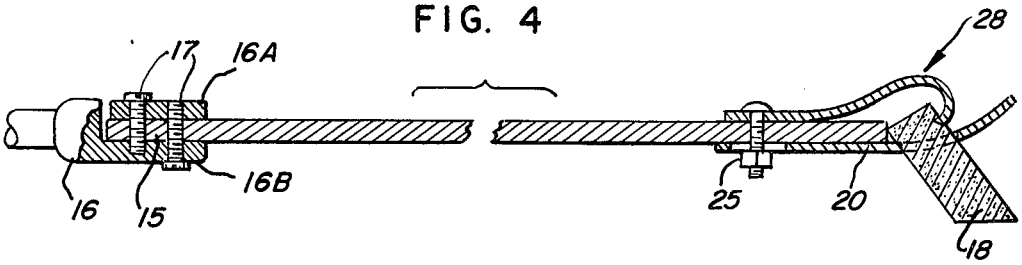
FIG. 4 is a sectional view taken on line 4-4 of FIG. 3.

Referring now to FIG. 1 a power device 10 of a type well known in the art as illustrated. Device 10 is adapted to impart desired reciprocal movement to tool holder 12 made in accordance with this invention. Device 10 is similar in appearance and construction to a common hand drill but provides short reciprocating strokes. In some motor driven tools this involves an eccentric conversion of rotary motion to linear motion. In others, the basic motive power is linear. Holder 12 comprises an elongate flexible wand 14 which has a clamp portion 16 to interconnect the wand and device 10. As shown in FIGS. 3 and 4 of the drawings clamp 16 may comprise a slotted member having a bight portion secured in device 10 and two legs 16A and 16B for reception of proximal wand end 15. Legs 16A and 16B traversed by bolts 17 and wand end 15 are threadedly engaging the opposite slot-defining which pass through clearance holes in one leg and the wand and leg 16A and 16B respectively. Thus, the wand end 15 is securely locked in the bifurcated clamp 16.

Holder 12 is adapted to support a finishing tool such as lapping stone 18 by means of a strip or blade 20 having aperture 22 through which the stone 18 passes. Aperture 22 is sufficiently large to receive a particular range of finishing stone sizes. However, the aperture must have an "effective" dimension 23 parallel to the holder axis which is approximately ⅛ inch greater than the dimension T of the stone received to enable the stone to assume a desired, approximately 155 degree angle relative to a tangent to the holder surface as illustrated in FIGS. 1 and 2. The effective opening length 23 may be obtained in various ways within the broad scope of the invention. In the embodiment of FIGS. 1–4, the effective dimension 23 for the blade opening 22 is obtained by positioning the terminal end 24 of wand 14 relative to the opening 22 in blade 20 so as to define the desired opening interval between the wand terminal end 24 and the opposed edge of opening 22. This opening is about ⅛ inch greater than thickness T of the specific stone 18 received as illustrated in FIGS. 1 and 2. The wand end 24 thus functions as an adjustable stone stop. A set screw 26 retains the blade, stone and wand in a desired assembled condition. Set screw 26 may be threaded into blade 20. A cooperating nut 27 may also be employed.

To assure retention of the stone 18 in the holder blade opening 22 when the holder is lifted from the work piece, a stone retaining clip 28 is provided. It has a curved hook-like terminus 29 to resiliently lock the stone 18 in the holder blade opening 22. The clip 28 resiliently urges the stone 18 against the wand end 24 to hold the stone 18 in place when the stone is not in engagement with the work piece. The blade edge 24 comprises an axis about which the stone is resiliently urged when the stone is in engagement with the work piece. In that case, the clip 28 is not functioning to hold the stone 18 but is held against forward edge 15 of blade 20 by a rotational force from the work piece. When in use the pressure applied to stone 18 through the wand and holder strip 20 locks the stone in opening 22 without the need for clip 28. The set screw 26 maintains the clip in assembly with the wand, stone and holder blade by traversing clip slot 27 positioned over a similar slot disposed in wand 14.

The wand 14 may be approximately 0.15 inch in thickness and the blade 20 approximately 0.035 inch in thickness. Both may be formed of a variety of materials such as nylon, steel shim stock, aluminum, brass or copper sheathing. The wand 14 which must flex in operation may also be formed of a mediumhard wood affording the desired flexibility. Clip 28 is preferably formed of light weight spring steel.

In the normal course of operation the power device 10 is held by a mold finisher diagramatically illustrated by hand 13 and the tool holder is positioned so that the stone 118 assumes a desired angle of approximately 45 degrees with the work piece 29 having surface 30. For illustrative purposes, the surface 30 shows substantial undulations which are atypical. Frequently the surfaces to be finished are perfectly flat or straight. It will be apparent from FIG. 1 that the abrasive stone 18 may continually maintain the desired angular relationship with the mold or die surface 30 regardless of the undulating nature of the surface thereof because of the small stone surface portion contacting such work surface. Stones of as little as approximately ¼ inch in thickness have been found to be extremely suitable for use with holder 12. Being of reduced thickness there is less chance for large stone surface areas to remain in continuous contact with the surface 30 thereby resulting in undesired "loading up" and inefficient cutting action. It is also possible to follow curves and work into restricted spaces. Thus, the desired stone-work surface angular relationship may be substantially maintained while simultaneously bringing new cutting edge portions of the stone 18 into working engagement with the surface 30 by slightly altering the angular relation between the stone and surface 30. Such new angular relation may be effected by merely flexing the wand 14 so as to "rotate" a new stone surface portion into cutting engagement with surface 20. Such ability to readily provide new cutting edges constitutes a form of "self dressing" operation.

The specific stone employed will of course depend on the nature of the operation carried out. Stones from 80 to 800 grit (silicon carbide or aluminum oxide) may be employed depending upon the metal being finished and its hardness.

The angle between the stone and wand may vary greatly during use within the preferred range of 130°–155°. There is a unique relationship in using this invention between stone angle, tool deflection angle and the tool pressure on the work. By way of example, a ten inch wand should deflect so that the center is approximately ½ inch below the unflexed wand axis with application of 2–3 pounds pressure at wand end 15. This angular relationship enables the power device 10 and the finisher to remain at a comfortable distance from the work surface within optimum pressure and tool angle regardless of the work contour. It is intended that the pressure applied to the working surface being finished by very light, generally under 5 pounds. It is normally desired that less than 0.003–0.004 inch of surface material be removed by the action above described, whereafter a finer flat stone may be used such as a 320 grit abrasive stone and/or a 600 grit abrasive stone followed by a diamond polishing. In some cases the amount of material used may be so slight as to be immeasurable.

The holder 10 will function efficiently with even relatively inexperienced operators because smooth lap cutting or working produces a recognizable and characteristic audible sound. If the proper sound is not heard the proper cutting angle may be readily assumed or additional lubricant such as kerosene provided to effect desired cutting.

The flexibility of wand 14 provides constant contact of the stone 18 on the material to be removed rather than producing chatter resulting in stone breakage and less cutting action. The best performance is obtained with a tool that reciprocates at a rate generally in the range of about five to about ten thousand strokes per minute. The stroke length is extremely short, perhaps only a few thousandths of an inch.

Figure 5:
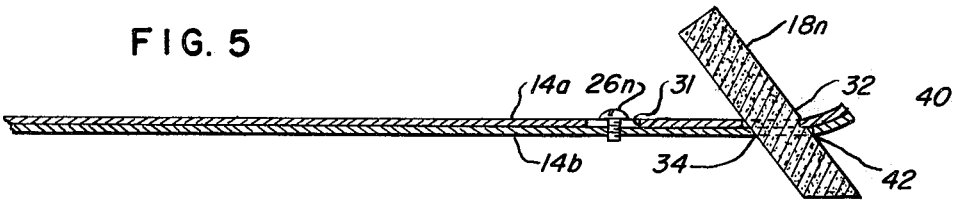
FIG. 5 is a fragmentary side elevational view of a modified tool holder made in accordance with this invention and particularly adapted for finishing narrow recesses and similar surface portions.
Figure 6:
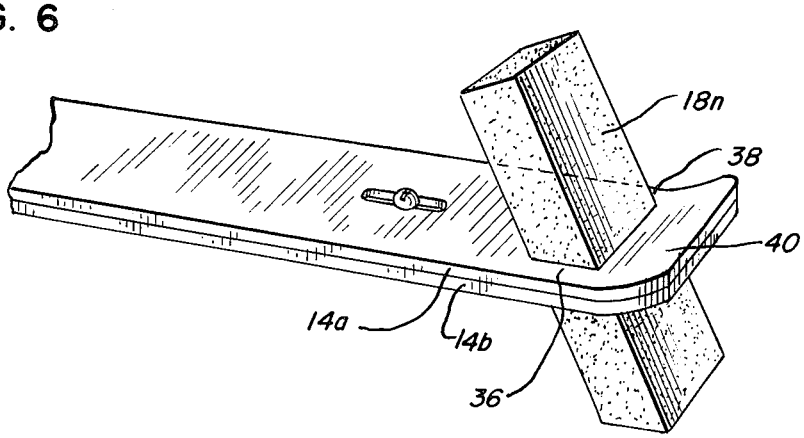
FIG. 6 is an enlarged perspective view of the tool holder of FIG. 5.

In the event extremely narrow surface areas are to be finished such as mold slots, the modified holder construction of FIGS. 5 and 6 may be employed utilizing two narrow and thin wands **14*a* and 14*b* holding narrow stone 18*n*. These wands are preferably formed of spring steel and do not employ a retainer clip but effect a lock on the stone 18*n* by moving the top wand back and bottom wand forward whereafter set screw 26*n* is tightened. The wand apertures 32 and 34 must provide a clearance with the engaged stone 18*n* in the dimension parallel to the wand axis of at least 0.015 inch to allow the stone to assume the desired angle. Upper wand 14*a* is slotted at 31 to permit desired positioning relative to the underlying wand 14*b*. A thickness of about 0.025 inch in wands 14*a* has been found to function satisfactorily. In the embodiment of FIGS. 5 and 6, the apertures 32 and 34 are defined by a pair of side arms 36 and 38 which support the end closure 40 to define the forward supporting edge 42. In some specialized applications side arms 36 could be omitted and arms 38** strengthened to enable precise corner or edge work. The length and width of the wand blades may of course be varied to accomodate the particular nature of the surface being worked, thus assuring optimum finishing efficiency.

It is seen from the foregoing that the described tool holder is extremely flexible in operation, providing a number of beneficial advantages. The ability of the stone supporting wand to flex performs a stone self-dressing function, enabling new stone cutting surface portions to be continually presented to the surface worked and also enable the operator to ascertain optimum cutting action audibly. The flex also meters and assures tool pressure. The tool may finish any mold surface regardless of configuration in complete safety while reducing the likelihood of stone breakage to a minimum. Since the provided holder enables a power-driven die profiler to effect delicate finishing operations previously carried out by hand, the above-described invention provides significant savings in labor previously deemed necessary to attain desired finishes.

What is claimed is:

1. A tool holder construction to support a work piece eroding tool against a work piece for reciprocation by a power source, said tool holder construction comprising:

an elongated flexible wand means having one end secured to such power source for reciprocation along the longitudinal axis of said wand means, tool support means at the other end of said wand means and having an aperture to receive said tool, said aperture being larger than the cross section of said tool along said axis whereby engagement of a free end of said tool with a work piece causes said tool to rotate into engagement with longitudinally spaced edges of said wand means which define said aperture, the angular disposition of said tool relative to said wand means tool support means being dependent upon the size of said aperture and resulting rotation of said tool relative to said longitudinally spaced edged, said tool support means being in such spaced relation with said wand means one end that the angular disposition of a tool disposed therein may be readily altered by flexing said wand means so as to rotate a new tool surface into engagement with said work piece.

2. The tool holder construction of claim 1 wherein said tool support means is separate from but secured to the elongate flexible portion of said wand means.

3. The tool holder construction of claim 2 wherein said support means is adjustably mounted on said flexible portion whereby said flexible portion partially overlies said aperture, and means releasably locking said support means on said flexible portion to define an effective aperture having a longitudinal dimension less than that of said aperture whereby the opposed surface portions of the tool disposed in said aperture are engaged by the opposite edge portions of said flexible portion and said support means and said tool is locked therebetween in response to rotary pressure on said tool about an axis transverse to said longitudinal axis and generally in the plane of said longitudinally spaced edges.

4. The tool holder construction of claim 1 wherein said elongate flexible wand means is a flat strip of material which is relatively rigid in directions parallel to the plane of said strip and relatially flexible transversely of the plane of said strip.

5. The tool holder construction of claim 1 wherein said flexible wand means comprises two overlying flexible flat strips and said tool support means comprises generally overlying aperture portions of said two strips.

6. The tool holder construction of claim 1 including tool retaining clip means mounted on said wand means and arranged relative to said aperture to resiliently urge said tool against a portion of said wand means adjacent said aperture and releasably locking means for adjusting the position of said clip means relative to said aperture.

7. The tool holder construction of claim 1 in which the size of said aperture is adequate to allow the axis of a tool disposed therein to assume an angle of generally 130° relative to the axis of said flexible wand means when held in place by pressure on said work piece.

8. The tool holder construction of claim 7 in which said flexible wand is flexible enough to permit the axis of said tool means to flex through an additional angle of about 25 degrees with respect to the axis of said flexible wand in the course of tool use when said tool is urged against a work surface.

9. A tool holder construction comprising superposed, slidably engageable, elongate, flexible wands having first end portions adapted to be clamped to a means for imparting oscillating motion, apertured second end portions of said wands opposed to said first end portions in cooperative engagement for reception of a tool such as a finishing stone or the like in said apertures, said means for locking said wands in a plurality of varying superposed relationships with said apertures partially overlying to define a single effective aperture to supportingly engage such tool.

10. A tool holder construction comprising an elongate flexible wand, a holder strip connected to an end portion of said flexible wand having an aperture therein for reception of a tool such as a finishing stone or the like, and a retaining clip supported by said wand for engaging and resiliently retaining said stone or the like against peripheral portions of said strip aperture.

11. A tool holder construction comprising an elongate flexible wand, a tool holder strip connected to an end portion of said wand and having an aperture for passage of a tool to be held thereby, said wand end portion being adjustably positioned over said holder strip aperture so as to define an effective tool-receiving opening in said holder strip, and securing means engaging said wand and tool holder strip for maintaining the same in desired assembled relationship.

12. A tool holder construction to support a work piece eroding tool against a work piece for reciprocation by a power source, said tool holder construction comprising:

an elongated flexible wand means having one end secured to such power source for reciprocation along the longitudinal axis of said wand means, said flexible wand means comprising two overlying flexible flat strips, tool support means at the other end of said wand means and having an aperture to receive said tool, said tool support means comprising generally overlying apertured portions of said two strips, said strips being longitudinally shiftable to define an effective aperture having a longitudinal dimension less than the longitudinal dimension of the apertures in said strips, and releasable locking means locking said strips against relative longitudinal movement whereby the opposed surface portions of the tool disposed in said effective aperture are engaged by the opposite edge portions of said strips and said tool is locked therebetween in response to rotary pressure on said tool about an axis transverse to said longitudinal axis and generally in the plane of said strips.

* * * * *

UNITED STATES PATENT OFFICE

CERTIFICATE OF CORRECTION

Patent No. 3,953,944 Dated May 4, 1976

Inventor(s) Edwin R. Olson

It is certified that error appears in the above-identified patent and that said Letters Patent are hereby corrected as shown below:

Abstract, line 3, "holer" should be --holder--

Column 1, line 6, "profile" should be --profiler--

Column 2, line 27, "as" should be --is--

Column 3, line 33, "118" should be --18--

Column 4, line 16, before "diamond" cancel "a"

Column 5, line 63, "releasably" should be --releasable--

Column 6, line 20, "said" (1st occurrence) should be --and--

Signed and Sealed this

Eighteenth Day of January 1977

[SEAL]

*Attest:*

RUTH C. MASON
*Attesting Officer*

C. MARSHALL DANN
*Commissioner of Patents and Trademarks*